US009200498B2

(12) United States Patent
Klimack

(10) Patent No.: US 9,200,498 B2
(45) Date of Patent: Dec. 1, 2015

(54) FLOW CONTROL HANGER AND POLISHED BORE RECEPTACLE

(75) Inventor: Brian K. Klimack, Tofield, CA (US)

(73) Assignee: KLIMACK HOLDINS INC., Edmonton, Alberta ( * ) Notice: Subject to any disclaimer, the term of this patent is extended or adjusted under 35 U.S.C. 154(b) by 789 days.

(21) Appl. No.: 13/316,867

(22) Filed: Dec. 12, 2011

(65) Prior Publication Data

US 2013/0146276 A1 Jun. 13, 2013

(51) Int. Cl.
*E21B 33/10* (2006.01)
*E21B 33/12* (2006.01)

(52) U.S. Cl.
CPC ..... *E21B 33/10* (2013.01); *E21B 33/1212* (2013.01)

(58) Field of Classification Search
USPC ..... 166/179, 195, 369, 116
See application file for complete search history.

(56) References Cited

U.S. PATENT DOCUMENTS

| | | | | |
|---|---|---|---|---|
| 4,109,942 | A * | 8/1978 | Morrill | 285/123.13 |
| 4,388,970 | A | 6/1983 | Setterberg | |
| 4,513,817 | A | 4/1985 | Weinberg | |
| 4,537,257 | A | 8/1985 | Todd | |
| 4,601,343 | A | 7/1986 | Lindsey, Jr. et al. | |
| 4,921,044 | A * | 5/1990 | Cooksey | 166/116 |
| 5,584,489 | A | 12/1996 | Abrams | |
| 6,382,324 | B1 | 5/2002 | Anyan | |
| 6,951,252 | B2 | 10/2005 | Restarick | |
| 7,128,157 | B2 | 10/2006 | Hoffman | |
| 7,775,271 | B2 | 8/2010 | Johnson | |
| 7,775,277 | B2 | 8/2010 | Johnson | |
| 7,784,543 | B2 | 8/2010 | Johnson | |
| 7,789,139 | B2 | 9/2010 | Johnson | |
| 7,789,151 | B2 | 9/2010 | Langeslag | |
| 7,793,714 | B2 | 9/2010 | Johnson | |
| 7,814,974 | B2 | 10/2010 | Sponchia | |
| 7,918,272 | B2 | 4/2011 | Gaudette | |
| 8,069,921 | B2 | 12/2011 | Garcia | |
| 8,113,292 | B2 * | 2/2012 | Huber et al. | 166/382 |
| 2008/0289813 | A1 | 11/2008 | Gewily et al. | |
| 2009/0283255 | A1 | 11/2009 | Huber | |
| 2009/0283272 | A1 | 11/2009 | Amaral | |

FOREIGN PATENT DOCUMENTS

| | | | |
|---|---|---|---|
| EP | 1496194 | A2 | 12/2005 |
| GB | 2305682 | A | 4/1997 |
| GB | 2436237 | A | 9/2007 |

* cited by examiner

*Primary Examiner* — David Andrews
(74) *Attorney, Agent, or Firm* — Field LLP

(57) ABSTRACT

A completion system is provided for completing downhole wells, comprising an upper polished bore receptacle incorporated into an intermediate casing of the downhole well and formed with a honed inner bore. A bottom packer for supporting a completion string within the intermediate casing has a first sealing assembly for sealing engagement against the inner bore of the upper polished bore receptacle. A lower polished bore receptacle is further incorporated into the intermediate casing and formed with a honed inner bore. A flow control hanger in the form of a hollow mandrel hangs a production liner in the intermediate casing and has a second sealing assembly for sealing engagement against an inner bore of the lower polished bore receptacle. A further completion system is provided comprising a polished bore receptacle (PBR) and a latch down packer having a lower end to which the PBR is connected.

16 Claims, 5 Drawing Sheets

FLOW CONTROL HANGER AND POLISHED BORE RECEPTACLE

TECHNICAL FIELD

The invention relates to a flow control hanger and polished bore receptacle for use in completing a well for oil and gas production.

BACKGROUND OF THE INVENTION

In oil and gas wells, after the production liners are installed, a completion string is installed into the well to produce well fluids. This completion string may contain a variety of tooling required to produce the wells fluids. In thermal wells, specialized tooling is required to allow for thermal expansion.

In thermal applications where steam is injected into the formation to loosen and fluidize well fluids, the tooling placed in the well require special seals to withstand the injection pressures and temperatures of steam, which are in the range of 350° C. at 2500 PSI. Special tooling required for steaming typically includes a bottom packer, sliding sleeve, expansion joints as well as pumps and the completion string connected to the surface. Seals found in the bottom packer, sliding sleeve, and expansion joints are all known to have seal failures over time, resulting in a loss of quality and quantity of steam being delivered to the formation, which in turn also lead to lowered production rates.

During steaming of the well, the steam can be delivered from surface either through the completion string or through an intermediate casing to the production liner in the open hole below the intermediate casing. In either procedure, the completion string is subject to thermal changes. Most often, steam is delivered through the completion string, which protects the intermediate casing from thermal expansion, as well as surface equipment such as the well head. During this process, the sliding sleeve is in a closed position which isolates the completion string from the intermediate casing. During steaming, all seals are subject to steam temperatures and pressures. As the completion string grows under thermal expansion, the expansion joints close. During production, the sliding sleeve is operated in an open position to connect the completion string and to the intermediate casing annulus. This is done to vent off any gases that could enter from the pump side to the intermediate casing side. As the well is produced and temperatures and pressures slowly decrease, the expansion joint begins to open again. All these seals, especially the expansion joint seals, are subject to failure, affecting wellhead temperatures and cemented casing expansions. This can result in casing and wellhead failures.

The bottom packer contains seals on its outside diameter which seal to the intermediate casing and seals on its inside diameter to seal to the completion string. The bottom packer is run in the hole to a pre-determined depth and the seals are set by compressing them to force the seals in an outward position. The compression continues until the outside diameter seals of the packer, are forced against the inside diameter of the intermediate casing. The bottom packers usually consists of a ratchet ring, which has a one direction movement. As the seals are compressed, the ratchet ring locks, preventing the seals from returning to their original position, thus creating the seal.

Known sliding sleeves consist of a tube within a tube. The outer tube or sleeve has holes through its wall. The inner tube or sleeve consists of two sets of seals to seal against either side of the holes on the outer sleeve. Movement of the inner sleeve will open the holes and allow communication between the completion string and the intermediate casing annulus.

Expansion joints typically used in the art consist of an inner sleeve and outer sleeve and a set of seals. The inner sleeve is connected to the completion string above and the outer sleeve is connected to the completion string below. As the completion string expands or contracts, movement of the expansion joint is meant to relieve any stresses the completion string would of otherwise be subject to.

In most existing tools, the seals are of elastomeric or graphite material. As such, it is not uncommon for them to wash, become brittle from the heat and break. Such seals typically do not have any memory and do not return to their original shape after being stressed.

The intermediate casing itself can also aid in creating a poor seal. The intermediate casing may not always have a uniform diameter to seal to. API specifications dictate that the casing wall thickness must be within +/−12% of the total wall thickness, which allows for a great deal of variance. Typically, two types of casing are made; a seamless pipe and an ERW (electric resistivity weld) pipe. The seamless pipe is manufactured from a solid bar stock and has no seam, but the wall thickness will vary within the 12% allowable through the entire length of the pipe. The ERW pipe has consistent wall thickness but contains a weld seam that runs the entire length of the pipes inside diameter. In both cases, either the weld seam or the wall thickness variance can affect the seal performance of the bottom packer.

It is therefore desirable to develop a completion device that can ensure better sealing against the intermediate casing and production liner, and also reduce seal failure.

SUMMARY OF INVENTION

A completion system is provided for completing downhole wells. The system comprises an upper polished bore receptacle incorporated into an intermediate casing of the downhole well and formed with a honed inner bore and a bottom packer for supporting a completion string within the intermediate casing and having a first sealing assembly for sealing engagement against the inner bore of the upper polished bore receptacle. The first sealing assembly comprises a mandrel having at least one threaded connection at an end of the mandrel to mate to the completion string, one or more end caps threaded to an outside diameter of the mandrel and having angled faces, one or more pairs of end seals and one or more mid seals placed between each pair of end seals. A lower polished bore receptacle (PBR) is also incorporated into the intermediate casing and formed with a honed inner bore. A flow control hanger (FCH) in the form of a hollow mandrel is used for hanging a production liner in the intermediate casing and having a second sealing assembly for sealing engagement against an inner bore of the lower polished bore receptacle. The second sealing assembly comprises a mandrel having at least one threaded connection to mate to the production liner and a flat faced stop shoulder, one or more end caps threaded to an outside diameter of the mandrel and having an angled face, one or more split seals and one or more stop rings. A further completion system is provided for completing downhole wells comprising a polished bore receptacle (PBR) and a latch down packer having a lower end to which the PBR is connected. A seating nipple is installed at a lower end of the PBR and a sealing assembly passes through the latch down packer and is seated inside the PBR and connected to a completion string.

BRIEF DESCRIPTION OF THE DRAWINGS

The present invention will now be described in greater detail, with reference to the following drawings, in which.

DETAILED DESCRIPTION OF THE INVENTION

The present invention provides a Flow Control Hanger (FCH) and Polished Bore Receptacle (PBR) that acts to create a seal that can withstand the pressures and temperatures of the steam. The seal must withstand steam pressures and temperatures while enduring movement due to thermal expansion and contraction.

The seal needs to be able to withstand 350° C. steam temperatures and 2500 PSI steam pressures. Furthermore, the seal needs to maintain elasticity and not become brittle. Preferably, the seal will contain a positive memory at all times to seal to an uncontrolled casing inside diameter.

Figure 1:
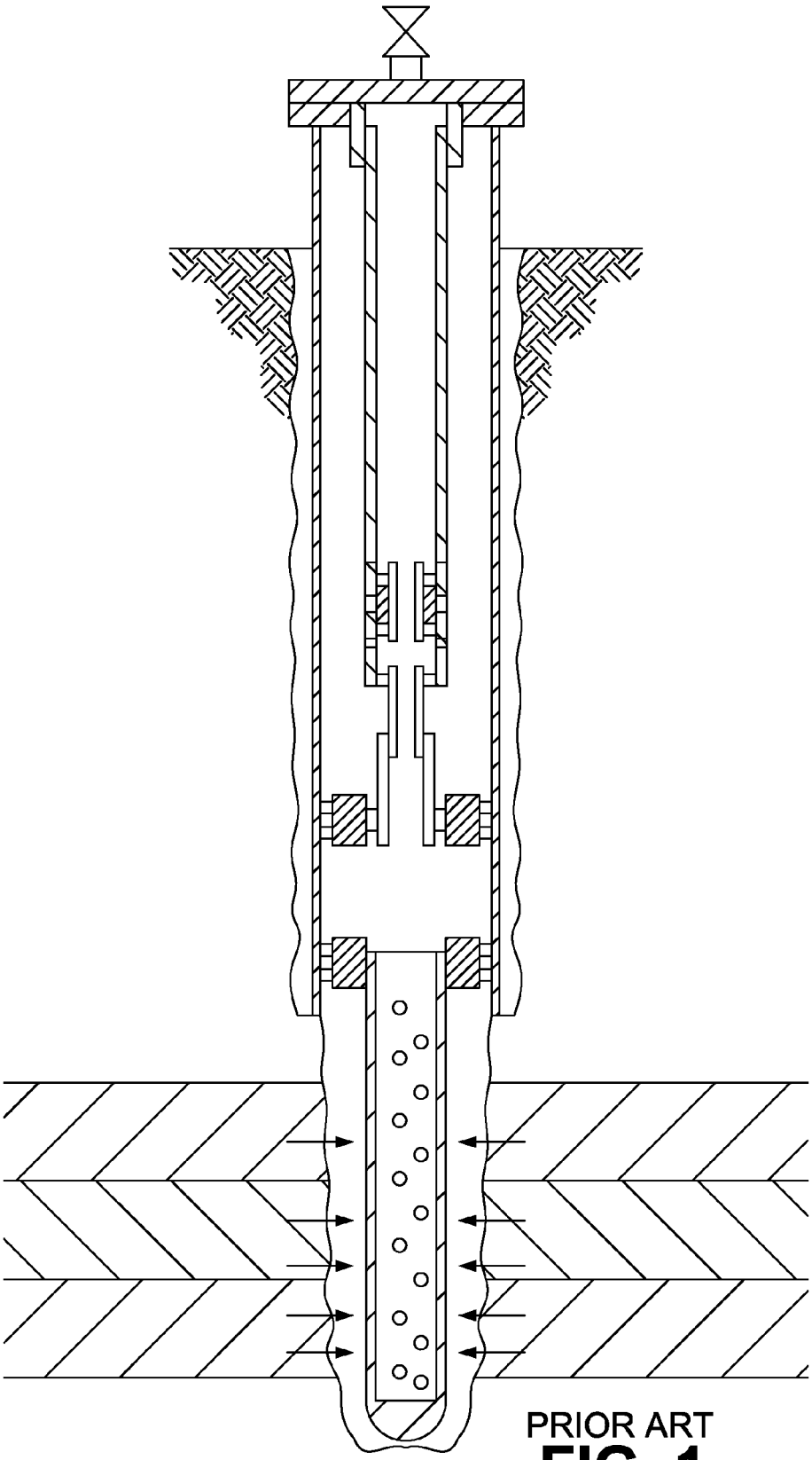
PRIOR ART FIG. 1
FIG. 1 is an elevation view of a downhole well, depicting one embodiment of the prior art.

FIG. 1 represents one example of the prior art. The liner hanger is run in the hole to a determined depth and the seals are set. The production liner is connected below the liner hanger, and drill pipe is connected above the liner hanger to surface. The liner hanger can be deployed either hydraulically or mechanically. In either case, the seals are compressed by pressure or weight to force the seals outwardly. The compression continues until the seals are forced against the inside diameter of the intermediate casing. The hangers usually consist of a ratchet ring, which has a one direction movement. As the seals are compressed, the ratchet ring locks, not allowing the seals to return to their original position, creating the seal. A release mechanism is run in conjunction with the liner hanger to release the drill pipe from the liner hanger, after it is set. If slips are required to hold the production liner off bottom, these slips are deployed at the same time and in the same manner as the seals are set.

Since these seal assemblies are compressed and held in this position by ratchet locking rings, the seal always contains a negative memory. In other words, if the assembly was to lose its seal and leak, there is no positive pressure to re-seal the assembly. The ratchet ring only holds the seal position and can't apply positive memory on its own. In some cases, the ratchet ring can slip, causing the seals to release.

Movement of the seal assembly within the casing, to a different position in the casing, could change the casing form to the permanent seal form of the assembly, resulting in a leak. Any minor change in either the seal form or casing form, using a permanent set seal with negative memory, will result in a leak.

Figure 2:
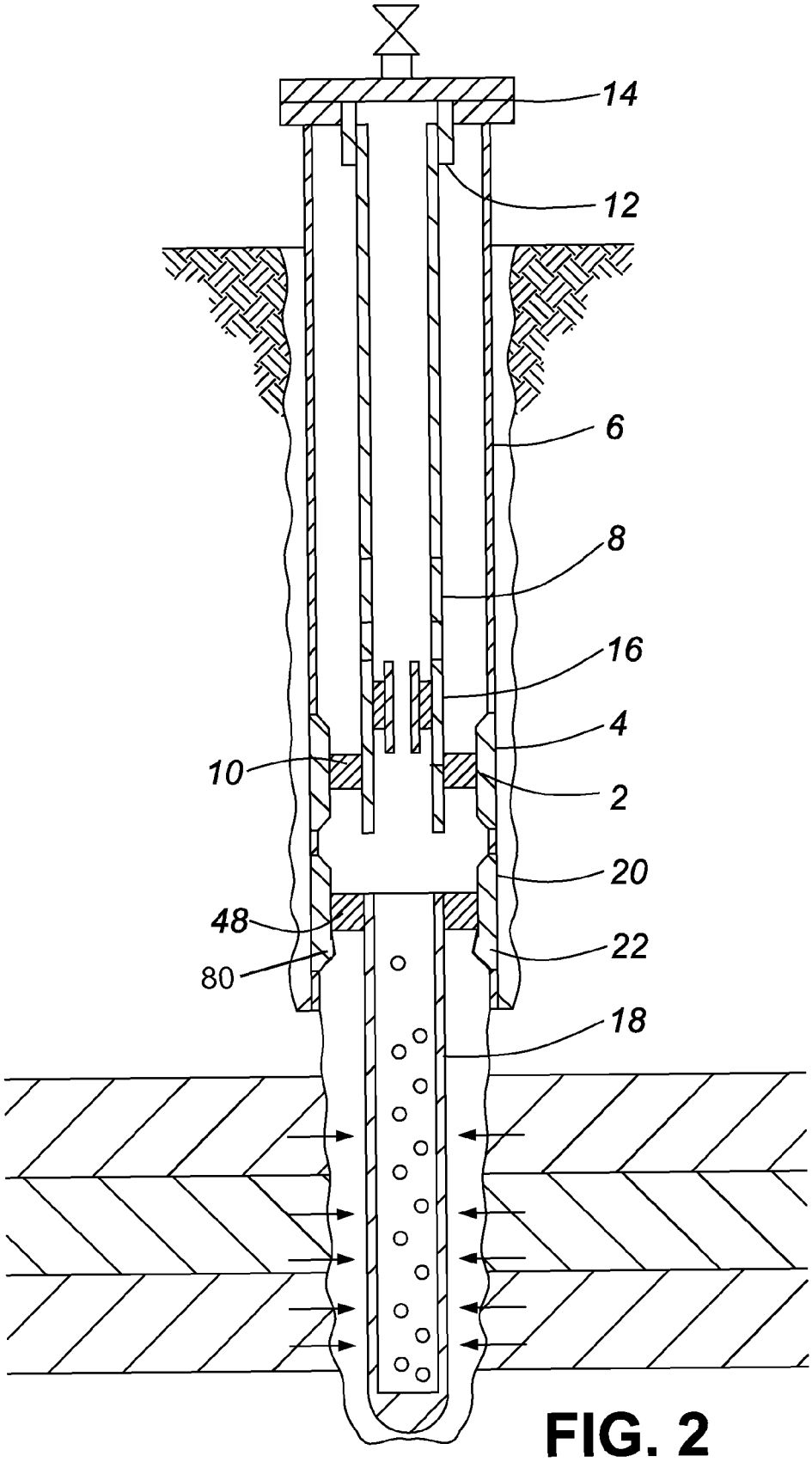
FIG. 2 is an elevation view of a downhole well, depicting one embodiment of the present invention.

FIG. 2 depicts one embodiment of the present invention, illustrating a downhole well fitted with an intermediate casing 6, hung with a completion string 8 and a production liner 18. The completion string 8 is at ambient temperature when installed. A bottom packer 2 is positioned at a top portion of an upper polished bore receptacle (PBR) 4. The completion string 8 is then hung by a completion string bonnet or hanger 12 from the bottom of the well head equipment 14. As steam enters the well through the wellhead 14, the completion string 8 is heated and expands in length. As the completion string 8 expands, it advances down the well bore, moving the bottom packer 2 lower but still within the upper PBR 4. As the completion string 8 moves within the upper PBR 4, it maintains a constant seal to the intermediate casing 6 and the bottom packer 2 slides to compensate for the completion string 8 movement, continuing to seal as it moves. This novel arrangement serves to combine two different tool functions into one tool, eliminating the number of seal components required.

Since the present upper PBR 4 replaces the outer barrel of a traditional expansion joint, there are no restrictions to the dimensions of the outside diameter of the expansion joint. This allows the upper PBR 4 to be built thicker, and thus stronger. As well, the additional room allows for the seal assembly 10 and seals to be designed with greater strength, as the only restriction in the design of the associated sliding sleeve 16 is that the inside diameter must match the completion string 8 inside diameter. The bottom packer 2 joint can also be built larger than traditional packers, to accommodate a variety of pump sizes and completion string 8 sizes.

The completion string 8, pump barrels and other tools can be connected to the present bottom packer 2 in the same manner as known bottom packers in the art. As well, the sliding sleeve 16 can be operated in a similar manner as traditional sliding sleeves, using the same tooling.

Below the completion string 8 and its sealing equipment resides a second seal assembly 22 that hangs and seals the production liner 18 to the intermediate casing 6. The production liner 18 can be a sand control liner or perforated liner that will deliver the steam to the formation, and transfer the produced oil from the formation to the completion string pump. The second seal assembly 22 also requires movement and sealing characteristics due to thermal expansion of the production liner 18.

In a preferred embodiment, an upper PBR 4 seals the completion string 8 and a lower PBR 20 seals the production liner 18. The upper PBR 4 has a larger inside diameter than the lower PBR 20. This will allow the production liner 18 and the second seal assembly 22 to pass through the upper PBR 4 and seal to the lower PBR 20. The seal assembly 22 of the completion string 8 then seals to the upper PBR 4.

Figure 3:
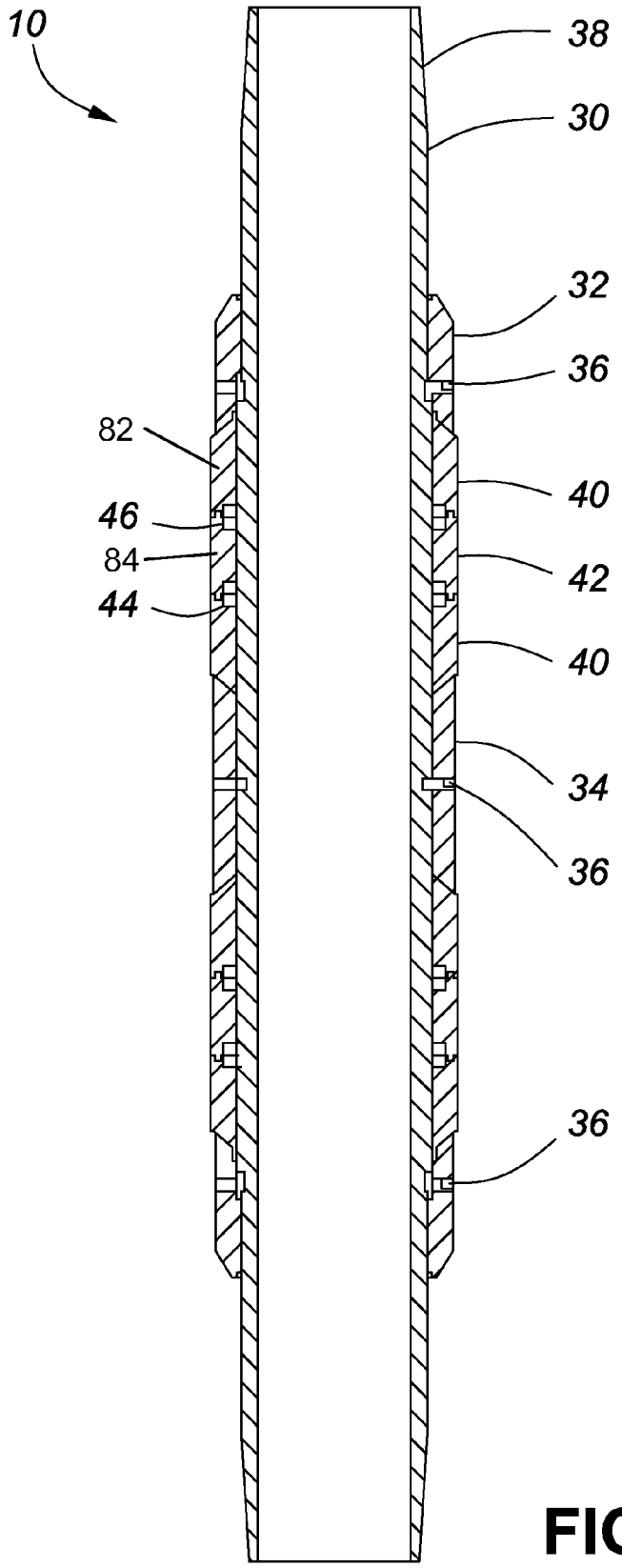
FIG. 3 is a cross sectional view of one embodiment of the sealing assembly of the present bottom packer.

The present bottom packer 2 contains a novel first seal assembly 10, depicted in FIG. 3. Some differences in the present bottom packer 2 are the seal material, seal setting procedure and the removal of inner completion string seals assembly. The seal material is made of any number of temperature and pressure resistant materials, including stainless steel, aluminum, lead and heat resistant plastic or rubber compounds. The seal material is preferably steel, which is able to withstand temperatures and pressures higher than steam. The wear resistance of metals, and particularly steel, is greater than traditional rubbers or graphite. Furthermore, metals provide a positive memory, which can preferably be set at the surface rather than down hole to allow a positive seal against its mating polished bore receptacle 4.

FIG. 3 depicts the present sealing assembly 10 of the bottom packer 2. The bottom packer 2 comprises a mandrel 30 that houses the seals, end caps 32 and preferably a spacer ring 34. The mandrel 30 preferably contains male threads on the end caps 32 and machined shoulders for positioning the spacer ring 34 and one or more set screws 36. The mandrel 30 contains male or female threaded connections 38 on both ends to mate to the completion string 8 or other tooling. The threaded connections 38 can preferably be custom threaded to the well requirements. The inside diameter and outside diameter of the mandrel 30 is preferably machined to mate to a 4½ completion string 8 and can be further preferably crossed over for a 3½ completion string 8. In this preferred embodiment, the same bottom packer 2 can be used with a 4½ or 3½ completion string pump.

The end caps 32 are threaded onto the outside diameter of the mandrel 30 and act to hold the seals to the mandrel body and allow setting of the seals. As the end caps 32 are tightened, they force the seals together, which in turn abut against the stationary spacer ring 34. As the end cap 32 is tightened, the angles force the seals closer to the outside diameter of the mandrel 30, thereby closing a cut on the seals. The more the end cap 32 is tightened, the more it a) closes the cuts, b) decreases the gap between the inside diameter of the seals and the outside diameter of the mandrel 30, c) decreases the interference fit between the outside diameter of the seals to the inside diameter of the polished bore receptacle 4. The end caps 32 are secured to the mandrel 30 with three set screws 36 after adjustments and assemblies are completed.

Each seal assembly 10 consists of two end seals 40, which are placed on either side of a mid seal 42. The end seals 40 preferably have an angled taper on one side to match an optional angle of the end caps 32 or spacer ring 34, and preferably also have a shouldered face on the other side to match a mating shouldered face of the mid seal 42. The end seals 40 further preferably have a controlled width cut 82 which splits the seal along its length. Each end seal 40 preferably has a pin pocket 46 located on its shouldered face at 180° opposite to the cut. The end caps 32 preferably have an angled face that matches mating angled faces of end seals 40. The same angle match is located at the spacer ring 34 as well.

The mid seal 42, which is placed between the two end seals 40 of the seal assembly 10, preferably has shouldered face ends to match the mating shouldered faces of the end seals 40. The mid seal 42 further preferably has a controlled width cut 84 which splits the seal along its length. The mid seal 42 also preferably has a pin pocket 46 located on the both shouldered faces, at 180° opposite to the cut.

The spacer ring 34 is placed between the two seals. The spacer ring 34 has an angled faces on both sides to match the angled face of the end seals 40. The spacer ring 34 is equipped with set screws 36, which will hold the spacer ring 34 to the outside diameter of the mandrel 30 in a permanent position. End caps 32 located on either side of the seals act to tighten the seals against the spacer ring 34 on either side.

Preferably, anti-rotation pins 44 are located between each matching shouldered face of the mid seal 42 to the shouldered face of the end seal 40. When the seal assembly 10 is assembled, the anti rotation pins 44 fit into the pin pockets 46 of the seals before they are fitted to each other. This ensures that no rotational movement of individual seals can occur, thus eliminating the possibility of seal cuts lining up and creating a leak path.

Each end cap 32 preferably includes one or more set screws 36, and more preferably four set screws. Once the end cap 32 has been tightened to a preferred position, the set screws 36 are tightened to hold any further rotation of the end caps 32 in either direction. The set screws 36 tighten to the outside diameter of the mandrel 30. There are also one or more set screws 36, and preferably four set screws, on the spacer ring 34. When the spacer ring 36 is installed, it is placed in the centre of the mandrel 30, over top of a machined outside diameter shoulder on the mandrel 30. The set screws 36 are tightened to the outside diameter of the mandrel 30, placing the set screws 36 within the shouldered groove. This eliminates any side movement as well as any rotational movement of the spacer ring 34.

The present bottom packer 2 uniquely acts as both a packer and as an expansion joint. Since the bottom packer 2 is allowed to move and is located within the upper PBR 4, this configuration now resembles an inner and outer sleeve of a typical expansion joint used in most completion strings and can operate in the same manner. As the completion string 8 expands and contracts from thermal expansion, the bottom packer 2 will move with the completion string 8, continuously keeping a seal to the intermediate casing 6, or preferably to the upper PBR 4, which is part of the intermediate casing 6. As the completion string 8 changes in length, the bottom packer 2 within the upper PBR 4 compensates for the change by moving up or down within the upper PBR 4, operating as the expansion joint and relieving stresses in the completion string 8.

The bottom packer seal assembly 10 outside diameter is designed to be slightly larger than the inside diameter of the upper PBR 4, thus allowing the installation of the bottom packer 2 with a clearance to the intermediate casing 6 above the upper PBR 4. Once the bottom packer 2 reaches the top of the upper PBR joint 4, the seal assembly 10 will compress or collapse to the inside diameter of the upper PBR 4. As the bottom packer 2 is placed within the upper PBR 4, the seal assembly 10 seals against the inside diameter of the upper PBR 4 with positive memory.

The upper PBR 4 can preferably have two different functions. Depending on the well, the injection completion string 8 is sometimes preferably placed inside the production liner 18, for the length of the production liner 18, and hung down the well. In this arrangement, the injection completion string 8 has a different rate of expansion than the production liner 18, therefore both strings would require separate bottom packers 2 or flow control hangers 22. The upper PBR 4 is preferably used to hang the injection completion string 8 inside the production liner 18, while the lower PBR 20 is preferably used to hang the production liner 18, allowing for each string to have its own independent growth and seal. Depending on the designed length of the upper PBR 4, it can further preferably contain both the injection completion string 8 to the bottom well bore, as well as the pump completion string to surface. Alternately, a third PBR can preferably be installed in the well.

The present polished bore receptacles (PBR) 4, 20 act to replace typical casing joints in the intermediate casing. The PBRs 4, 20 have a honed inside diameter to provide a continuous, controlled surface area against which the seal assembly 10 of the bottom packer 2 can seal. The present PBRs 4, 20 eliminate inconsistent wall variances often found in seamless casings and eliminate the welded seam of an ERW casing. The PBRs 4, are preferably built in lengths to allow for maximum movement of the completion string 8 due to thermal expansion and contraction. The PBRs 4, 20 are further preferably treated for surface hardening and corrosion resistance to enhance performance of the bottom packer 2.

The lower PBR 20 is preferably machined from a joint of casing that has a larger casing wall thickness than the intermediate casing 6 and has a smaller honed inside diameter than the upper PBR 4. This allows the FCH 22 to pass through the upper PBR 4. The PBR will be honed to an inside diameter that is smaller than the nominal inside diameter of the intermediate casing 6, and larger than the drift diameter of the intermediate casing 6. A "no-go" 80 is preferably machined to the inside diameter near the bottom of the lower PBR 20, preferably in the form of a smaller-than-honed inside diameter to stop passage of the FCH 22 through the lower PBR 20. The length of the lower PBR 20 is calculated based on the thermal growth expected while in use.

The inside diameter of the lower PBR 20 is preferably treated to enhance material hardness and corrosion resistance after machining is completed. This treatment protects the honed inside diameter from drilling tool damage, as drilling will continue through the intermediate casing after it is set.

Figure 4:
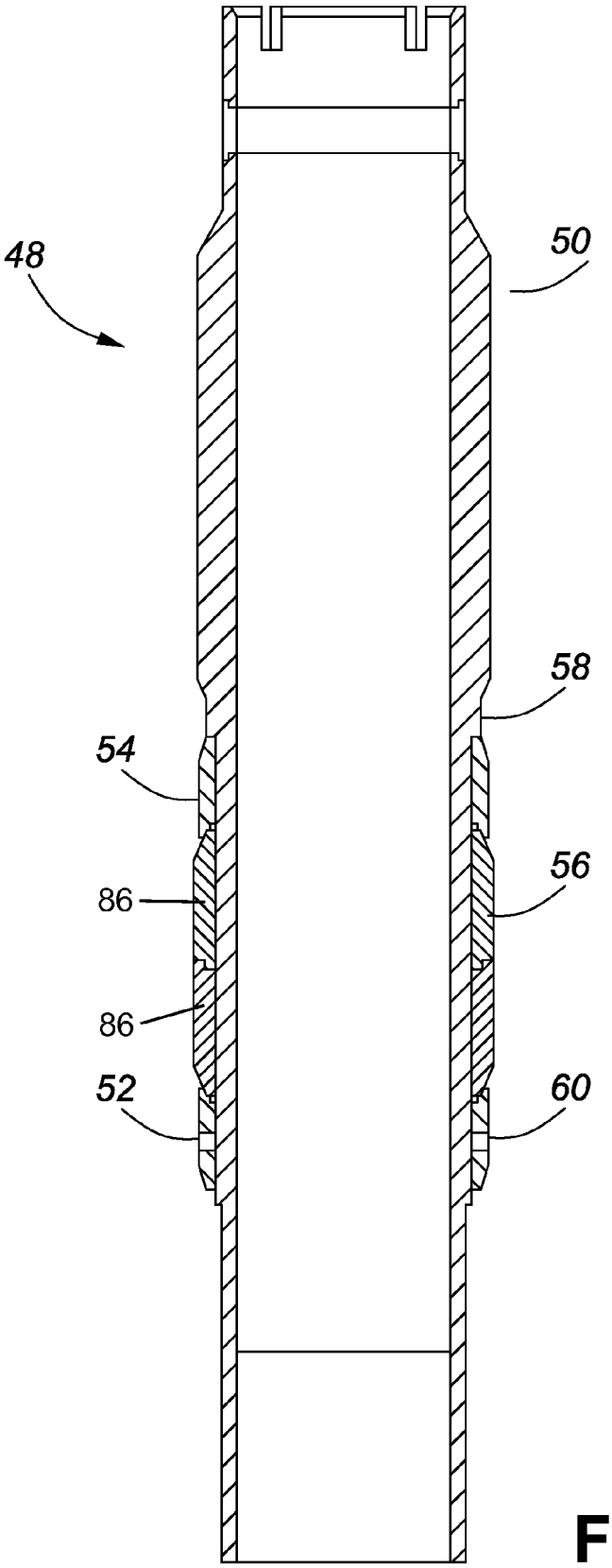
FIG. 4 is a cross sectional view of one embodiment of the sealing assembly of the present flow control hanger.

The flow control hangar 22 is fitted with an associated second sealing assembly 48. In one embodiment, the sealing assembly 48 can be made using the same design and parts as the sealing assembly 10 of the bottom packer 2. A preferred embodiment of the sealing assembly 48 of the FCH 22 is shown in FIG. 4.

The sealing assembly 48 comprises a mandrel 50 that houses one or more split seals 56, one or more end caps 52 and one or more stop rings 54. The mandrel 50 contains male threads for the end cap 52, and a machined stop shoulder 58 for the stop rings 54. The mandrel can further contain male or female threaded connections on both ends to mate to the production liner 18 or release tools. These connections can also be custom threaded to particular well requirements. The inside diameter and outside diameter of the mandrel are honed to mate to the production liner 18 below it.

The end cap 52 threads on to the outside diameter of the mandrel 50 and holds the split seals 56 to the mandrel body. As the end cap 52 is tightened, it forces the split seals 56 together to abut the stationary stop ring 54. The end cap 52 has an angled face which matches a corresponding angled taper on the ends of each split seal 56. As the end cap 52 is tightened, the angled face forces the seals closer to the mandrel 50 outside diameter and closes a controlled width cut 86 formed on the split seals 56. The more the end cap 50 is tightened, the more it a) closes the cuts, b) decreases the gap between the inside diameter of the split seals 56 and the outside diameter of the mandrel 50 and c) decreases the interference fit between the outside diameter of the split seals 56 to the inside diameter of the polished bore receptacle 20.

Each seal assembly 48 consists of two split seals 56. Each split seal 56 will have an angled taper to match the angled face of the end cap 52 or an angled face of the stop ring 54, and a shouldered side to mate to other split seals. Each split seal 56 has a controlled width cut 86 along its length. Each split seal 56 has a pin pocket located on the shouldered face side, located 180° opposite to the cut.

The stop ring 54 is placed against the stop shoulder 58 of the outside diameter of the mandrel. The stop ring 54 will have an angled face on one side to match the angled face of the split ring 56, and a flat face on the other side to match the flat face of the stop shoulder 58 on the mandrel 50.

An anti rotation pin located between the matting shoulder faces of the split seals 56. Each shouldered face on each split seal 56 will contain a pin pocket which is located 180° degrees opposite the cut. When the split seals 56 are assembled, the anti rotation pin is placed in the pin pockets of the split seals 56 before they are fitted to each other. This ensures that no rotational movement of individual seals can occur, thus illuminating the possibility of seal cuts lining up and creating a leak path.

The end cap 52 preferably includes one or more, and more preferably three, set screws 60. Once the end cap 52 has been tightened to its preferred position, the set screws 60 are tightened to hold any further rotation of the end cap 52 in either direction. The set screws 60 tighten to the outside diameter of the mandrel 50.

One notable difference in the present FCH 22 is the seal material and seal setting procedure. The seal material is metal, preferably steel. Metal can withstand steam temperatures and pressures seen during thermal treatment. The wear resistance of metal versus rubber or graphite is also better and will not wash. Metal further provides a positive memory unlike a brittle material such as baked rubber. The seal assembly 48 is set in accordance with its mating lower polished bore receptacle 20 which is part of the intermediate casing 6.

The lower PBR 20 acts to replace the casing joint into which a traditional casing liner hanger would normally be set. The lower PBR 20 has a honed inside diameter to provide a continuous controlled surface area for the seal assembly 48 to seal to. The present lower PBR 20 address the issue of inconsistent wall variance found in traditional seamless casings, while also eliminating the welded seam of ERW casings. The lower PBR 20 is preferably built in lengths to allow for maximum movement of the FCH 22 due to thermal expansion and contraction. The lower PBR 20 is also preferably treated for surface hardening and corrosion resistance to enhance performance of the FCH 22. The lower PBR 20 is assembled to intermediate casing 6 and is placed near the bottom of the intermediate casing string 6. The bottom of the lower PBR 20 is preferably furnished with a no-go 80, in the form of a slightly smaller inside diameter then the honed area above it. This no-go 80 acts to prevent the FCH 22 from passing thought the lower PBR 20. The present no-go 80 acts in a similar manner to slips that are typically located on known liner hangers, with the exception that the no-go 80 allows the FCH 22 to move within the lower PBR 20, but not to exit the lower PBR 20. The present FCH 22 seal assembly 48 allows the production liner to hang from the no-go 80, thereby eliminating the need for traditional slips.

The present bottom packer 2 and flow control hanger 22 seals are made of metal, preferably steel, which provides a positive memory seal to the completion string 8 and the production liner 18.

In operation, the bottom packer 2 is connected to the bottom of a pump barrel and or completion string 8. The completion string 8 is run into the cased well bore until the bottom packer 2 reaches the top of the upper PBR 4. As soon as the seals of the bottom packer 2 seal to the top of the upper PBR 4, there is a reduction of weight of the completion string 8. As the weight of the completion string 8 on the seals increase, the seals of the bottom packer seal assembly 10 collapse and compress until the seal outside diameter matches the inside diameter of the honed upper PBR 4. Once these two diameters match each other, the seals of the bottom packer 2 slide inside the upper PBR 4 and the controlled width cuts 82, 84 of the end seals 40 and mid seals 42 close and seal any leak path that may have existed through the cuts. As the cuts close, the inside diameter of the spacer rings 34 seals to the outside diameter of the mandrel 30 of the bottom packer 2 and the outside diameter of the spacer rings 34 seal to the inside diameter of the upper PBR 4.

Should any passage of fluid through the controlled width cuts 82, 84 exist, these will become sealed at the shoulder face and will not be allowed to leak further through cuts on adjoining seals. The ends of the seal assembly 10 are angled, and mate to the spacer rings 34 with the same angle. One spacer ring 34 is stationary, while the second spacer ring 34 is adjustable. This adjustable spacer ring 34 tightens the seal assembly 10 together. As the adjustable spacer ring 34 is tightened, it forces itself against the stationary spacer rings 34 and also compresses the seals, which in turn adjust the outside diameter of the seal assembly 10. The outside diameter of the seals is adjusted to a determined outside diameter which is calculated from the honed inside diameter of the upper PBR 4. The interference fit between the seal outside diameter and the upper PBR 4 inside diameter determines how much weight is required to set the seals into the upper PBR 4. It also controls how much positive memory is set into the seal, and how much force is required to move the seal within the upper PBR 4 due to thermal expansion and contraction.

The distance that the bottom packer 2 is set inside the upper PBR 4 is predetermined. Typically, the installment of the completion string 8 is at ambient temperature, so the bottom packer 2 is set in the upper portion of the upper PBR 4. The completion string 8 at surface will be hung from the well head 14. Spacer joints can optionally be installed to the completion string 8 at the surface to adjust the depth of the bottom packer 2 in the upper PBR 4. As the completion string 8 expands from heat and its length increases, the bottom packer 2 tends to lower inside the upper PBR 4, while maintaining its seal to the upper PBR 4. As the completion string 8 cools, is length decreases, causing the bottom packer 2 to move upward inside the upper PBR 4, again maintaining its seal.

The production liner 18 is run into the well, with the FCH 22 attached at the top of the production liner 18, through the larger intermediate casing 6, and into the open hole that is drilled below it. When the bottom of the production liner reaches a predetermined depth, the FCH 22 will reach the top of the lower PBR 20. The FCH 22 is then pushed into the lower PBR 20 by the weight of the drill pipe above it. As the seal assembly 48 of the FCH 22 enters the top of the lower PBR 20, the seals compress or contract to fit the inside diameter of the honed lower PBR 20, and the leak passages of the seals are closed, eliminating or controlling the amount of leak path. The "no-go" 80 located at the bottom of the lower PBR 20 prevents the FCH 22 from exiting the lower PBR 20. The seals are now loaded with positive memory and therefore have a tendency to expand outwardly toward the inside diameter of the lower PBR 20, thus creating a positive seal. As the production liner 18 expands and contracts, the seal assembly 48 moves within the lower PBR 20, while always maintaining a positive seal. The metal material of the seals eliminates the chances of washing or brittle seal failure.

Figure 5:
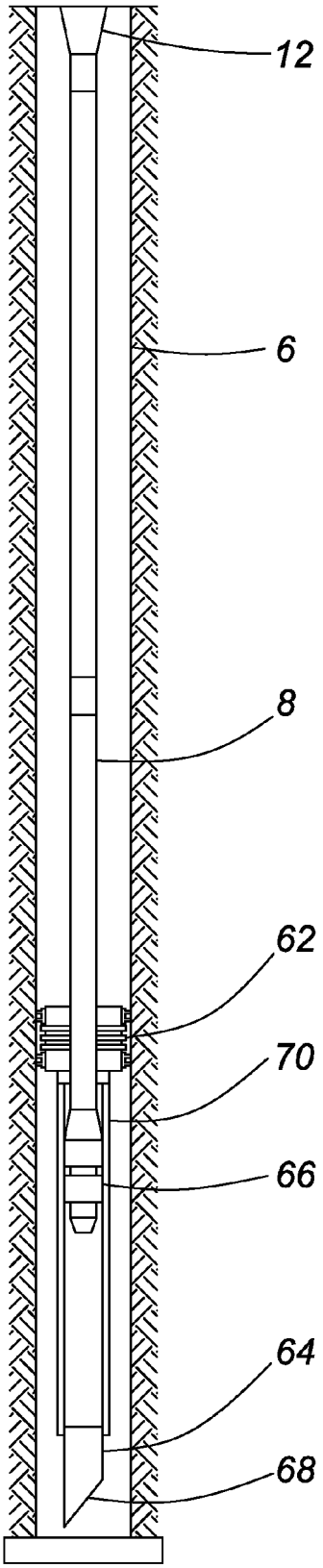
FIG. 5 is an elevation view of a downhole well, depicting a further embodiment of the present invention.

A further alternate embodiment of the present invention is illustrated in FIG. 5. This embodiment allows the present invention to be combined with an existing latch down packer, which in turn ensures that the well can be shut in using conventional seating nipples that are typically found on latch down packers. Referring to FIG. 5, in this alternate arrangement, the PBR is no longer located within the intermediate casing 6, but rather this PBR 70 is connected to the bottom of an existing latch down style packer 62. The PBR 70 in this embodiment is preferably sized to fit inside the intermediate casing 6 with at least some clearance. A seating nipple 64 is attached to a lower end of the PBR 70, which is in turn attached to a lower end of the latch down packer 62.

Similar to workings of the upper PBR 4 installed in the intermediated casing 6, a sealing assembly 66 passes through the latch down packer 62 to seat inside the PBR 70 below. The well can now be sealed with the latch down packer 62 using the combined sealing assembly 66 and PBR 70. Once sealed, the well is then shut in by installing the seating nipple 64 via a wire line unit 68 to the lower end of the PBR 70. The latch down packer 62 thus acts to seal the lower open end of the PBR 70 and an annular space around the casing 6. The attachment of the PBR 70 to the latch down packer 62 prevents movement of the PBR 70, thus sealing the well and allowing the completion string, including the sealing assembly 66 to be removed safely from the well. Connections on the PBR 70 are preferably honed to match bottom threads of the latch down packer 62 and to upper threads of the seating nipple 64.

In the foregoing specification, the invention has been described with a specific embodiment thereof; however, it will be evident that various modifications and changes may be made thereto without departing from the broader spirit and scope of the invention.

Having thus described the invention, what is claimed as new and secured by Letters Patent is:

1. A completion system for completing downhole wells, said system comprising;

a. an upper polished bore receptacle (PBR) incorporated into an intermediate casing of the downhole well and formed with a honed inner bore;

b. a bottom packer for supporting a completion string within the intermediate casing and having a first sealing assembly for sealing engagement against an inner bore of the upper polished bore receptacle; said first sealing assembly comprising:

i. a mandrel having at least one threaded connection at an end of the mandrel to mate to the completion string;

ii. one or more end caps threaded to an outside diameter of the mandrel and having angled faces;

iii. one or more pairs of end seals made of high temperature and pressure resistant stainless steel;

iv. one or more mid seals made of high temperature and pressure resistant stainless steel and placed between each pair of end seals;

wherein each of the one or more pairs of end seals include a controlled width cut along a length of the end seal, an angled taper on a first side of the end seal to mate with the angled face of the end caps or an angled face of a spacer ring, a shouldered face on a second side of the end seal to mate to a shouldered face of the mid seal, and one or more pin pockets located on the shouldered face of the end seal;

c. a lower polished bore receptacle (PBR) incorporated into the intermediate casing and formed with a honed inner bore; and comprising a no-go in the form of a smaller than honed inside diameter proximal a bottom end of the lower PBR;

d. a flow control hanger (FCH) in the form of a hollow mandrel for hanging a production liner in the intermediate casing and having a second sealing assembly for sealing engagement against an inner bore of the lower polished bore receptacle, said second sealing assembly comprising:

i. a mandrel having at least one threaded connection to mate to the production liner and a flat faced stop shoulder;

ii. one or more end caps threaded to an outside diameter of the mandrel and having an angled face;

iii. one or more split seals made of high temperature and pressure resistant stainless steel; and iv. one or more stop rings, wherein the no-go on the lower PBR serves to prevent passage of the FCH through the lower PBR.

2. The completion system of claim 1, wherein the one or more mid seals of the first sealing assembly each include a controlled width cut along a length of the mid sea, shouldered face ends to mate with the shouldered faces of the end seals and one or more pin pockets located on each shouldered face.

3. The completion system of claim 2, wherein the first sealing assembly further comprises;

a. one or more spacer rings placed between each combination of end seal pairs and mid seal and affixed to an outside diameter of the mandrel, having angled faces to match the angled face of the end seals; and b. one or more anti rotation pins inserted into the pin pockets of the mid seals and end seals to prevent rotation of mid seals and end seals and prevent alignment of controlled width cuts.

4. The completion system of claim 3, wherein the one or more split seals of the second sealing assembly further includes a controlled width cut along its length, an angled taper on a first side of the split seal to mate with the angled face of the end cap or with an angled face of a stop ring, a shouldered face on a second side to mate with other split seals and one or more pin pockets located on the shouldered face.

5. The completion system of claim 3, wherein the one or more spacer rings of the first sealing assembly are equipped with one or more set screws to hold the spacer ring against the outside diameter of the mandrel to prevent side motion or over-rotation.

6. The completion system of claim 4, wherein the one or more stop rings of the second sealing assembly includes an angled face on a first side to mate with the angled taper of the split ring and a flat face on a second side to mate with the flat faced stop shoulder on the mandrel.

7. The completion system of claim 6, wherein the second sealing assembly further comprises one or more anti rotation pins for insertion into the one or more pin pockets of the split seals, to prevent rotation of the split seals and prevent alignment of controlled width cuts.

8. The completion system of claim 7, wherein the pin pockets of the first and second sealing assemblies are located 180° opposite to the controlled width cut.

9. The completion system of claim 1, wherein an outside diameter of the first seal assembly is larger than an inside diameter of the upper PBR.

10. The completion system of claim 1, wherein the upper PBR has a larger inside diameter than the lower PBR, to allow the production liner the second seal assembly to pass through the upper PBR and seal to the lower PBR.

11. The completion system of claim 1, wherein the lower PBR and the upper PBR are treated for surface hardening and corrosion resistance.

12. The completion system of claim 1, wherein the one or more end caps of the second sealing assembly are equipped with one or more set screws to hold the end caps against over-rotation to the outside diameter of the mandrel.

13. The completion system of claim 1, wherein the one or more end caps of the first sealing assemblies are tightened against the end seals and mid seals to create a positive memory seal against the upper PBR.

14. The completion system of claim 1, wherein the one or more end caps of the second sealing assemblies are tightened against the split seals to create a positive memory seal against the lower PBR.

15. The completion system of claim 1, wherein the production liner is a sand control liner or a perforated liner for delivering steam to a formation and transfer product out of the formation.

16. A completion system for completing downhole wells, said system comprising:

a. an upper polished bore receptacle (PBR) incorporated into an intermediate casing of the downhole well and formed with a honed inner bore;

b. a bottom packer for supporting a completion string within the intermediate casing and having a first sealing assembly for sealing engagement against an inner bore of the upper polished bore receptacle, said first sealing assembly comprising:

i. a mandrel having at least one threaded connection at an end of the mandrel to mate to the completion string;

ii. one or more end caps threaded to an outside diameter of the mandrel and having angled faces;

iii. one or more pairs of end seals made of high temperature and pressure resistant stainless steel wherein the one or more pairs of end seals of the first sealing assembly each include a controlled width cut along a length of the end seal, an angled taper on a first side of the end seal to mate with the angled face of the end caps or an angled face of a spacer ring, a shouldered face on a second side of the end seal to mate to a shouldered face of a mid seal, and one or more pin pockets located on the shouldered face of the end seal;

c. a lower polished bore receptacle (PBR) incorporated into the intermediate casing and formed with a honed inner bore comprising a no-go in the form of a smaller than honed inside diameter proximal a bottom end of the lower PBR; and d. a flow control hanger (FCH) in the form of a hollow mandrel for hanging a production liner in the intermediate casing and having a second sealing assembly for sealing engagement against an inner bore of the lower polished bore receptacle, wherein the bottom packer is movable within the upper PBR while maintaining a continuous seal to the intermediate casing and wherein the no-go on the lower PBR serves to prevent passage of the FCH through the lower PBR.

* * * * *